US009228345B2

(12) United States Patent
Weber et al.

(10) Patent No.: US 9,228,345 B2
(45) Date of Patent: Jan. 5, 2016

(54) EXTRUDED DECK BOARD WITH FINISHING MATERIAL INSERT

(71) Applicant: Sigma Dek Ltd., Calgary (CA)

(72) Inventors: Tory Weber, Calgary (CA); Brian Boettger, Calgary (CA); Stephan Lachevrotiere, Quebec (CA); Francois Parenteau, Quebec (CA)

(73) Assignee: Sigma Dek Ltd., Calgary, Alberta (CA)

( * ) Notice: Subject to any disclaimer, the term of this patent is extended or adjusted under 35 U.S.C. 154(b) by 0 days.

(21) Appl. No.: 14/523,096

(22) Filed: Oct. 24, 2014

(65) Prior Publication Data

US 2015/0128519 A1 May 14, 2015

Related U.S. Application Data

(60) Provisional application No. 61/904,215, filed on Nov. 14, 2013.

(30) Foreign Application Priority Data

Jun. 25, 2014 (CA) ..... 2854945

(51) Int. Cl.

| | |
|---|---|
| ***E04F 15/10*** | (2006.01) |
| ***E04B 5/02*** | (2006.01) |
| ***E04F 15/02*** | (2006.01) |
| ***E04B 1/19*** | (2006.01) |
| ***E04B 5/43*** | (2006.01) |

(52) U.S. Cl.

CPC . *E04B 5/023* (2013.01); *E04B 1/19* (2013.01); *E04B 5/43* (2013.01); *E04F 15/02038* (2013.01); *E04F 15/02044* (2013.01); *E04F 15/02194* (2013.01); *E04B 2001/199* (2013.01); *E04F 2015/0205* (2013.01); *E04F 2015/02094* (2013.01)

(58) Field of Classification Search

CPC ..... E04F 15/10; E04F 15/02183; E04F 15/02; E04F 2203/04; E04B 1/003

USPC ..... 52/489.1, 483.1, 747.1, 582.1

See application file for complete search history.

(56) References Cited

U.S. PATENT DOCUMENTS

| | | | | |
|---|---|---|---|---|
| 3,914,913 | A | 10/1975 | Roberts | |
| 5,513,472 | A * | 5/1996 | Olsen et al. | 52/177 |
| 5,647,184 | A * | 7/1997 | Davis | 52/592.1 |
| 5,819,491 | A | 10/1998 | Davis | |
| 6,434,779 | B1 * | 8/2002 | Bartlett et al. | 15/215 |
| 6,729,097 | B2 * | 5/2004 | Patel et al. | 52/665 |
| 2005/0204683 | A1 | 9/2005 | Showers et al. | |

FOREIGN PATENT DOCUMENTS

| | | |
|---|---|---|
| EP | 1808546 | 7/2007 |

* cited by examiner

*Primary Examiner* — Jeanette E Chapman
*Assistant Examiner* — Daniel Kenny
(74) *Attorney, Agent, or Firm* — Ryan W. Dupuis; Kyle R. Satterthwaite; Ade & Company, Inc

(57) ABSTRACT

A plurality of intermediate deck boards span across joists in a decking system in which each deck board includes a lower frame portion extruded of a first material and an insert body inserted into the top side of the lower frame portion which is formed of a second material. Additional extruded members are used as starting and ending rows of the deck boards and as finishing boards across the ends of the intermediate deck boards, in which each of the deck boards defines a respective portion of an upper deck surface of the assembled deck structure. The perimeter extruded members include mounting channels for mounting a railing structure thereon.

21 Claims, 14 Drawing Sheets

EXTRUDED DECK BOARD WITH FINISHING MATERIAL INSERT

This application claims the benefit under 35 U.S.C. 119(e) of U.S. provisional application Ser. No. 61/904,215, filed Nov. 14, 2013 and claims foreign priority benefits from Canadian Patent Application 2,854,945 filed Jun. 25, 2014.

FIELD OF THE INVENTION

The present invention relates generally to a manufactured deck board arranged to be supported across joists in a patio deck structure using mounting clips, and more particularly the present invention relates to a deck board having an extruded main body and an insert body of finishing material received within a channel in a top side of the extruded main body, for example an extruded aluminum body which receives a ceramic material inserted into a top side of the aluminum body.

BACKGROUND

Various types of manufactured deck boards are known for use in construction of a patio deck structure for increased performance or durability as compared to conventional wooden deck boards which require regular maintenance by the application of paint or stain thereto.

Various examples of manufactured deck boards are disclosed in the following patent publications: U.S. Pat. No. 3,914,913 by Roberts; U.S. Pat. No. 5,819,491 by Davis; and EP 1808546 by Wybo. In many instances extruded material is used, such as plastic or metal, which results in a durable and strong deck board, but the finished appearance of the deck board is limited to the types of material which are suitable for extrusion and the materials for such extruded deck boards are typically selected based on performance rather than optimal appearance.

US2005/0204683 by Showers et al discloses another example of manufactured deck boards together with finishing boards for capping the deck boards about a perimeter of the assembled deck structure. The configuration of the finishing boards however only provide a decorative covering over the edges of the deck boards and are not suitable for anchoring the edges of the deck boards, nor do they contribute to increasing the upper deck surface area. Furthermore, no means are provided to accommodate for attachment of a railing in a secure manner.

SUMMARY OF THE INVENTION

According to one aspect of the invention there is provided a deck board for use in spanning in a longitudinal direction across a plurality of joists in a deck structure, the deck board comprising:

a main body which is elongate in a longitudinal direction, the main body including two side portions extending in the longitudinal direction along opposing sides of the body and a frame portion integrally joined between the side portions, the frame portion being recessed in height relative to the two side portions such that the two side portions and the frame portion define a recessed channel spanning in the longitudinal direction along a top of the main body;

an insert body received within the recessed channel in the top of the body and formed of a different material than the extruded body.

By providing a main body having a recessed channel which receives an insert body therein, a first material can be selected for strength and performance as an extruded member while a second material can be selected based on the desired finished appearance. The bending strength of the insert body material is not essential such that the insert body can instead be selected based on optimal appearance and/or wear resistance at the surface.

Preferably the main body comprises extruded metal, and the insert body is a rigid unitary material, for example ceramic or plastic material. More preferably the insert body is a finishing material which remains exposed at the top side of the main body.

In some instances the insert body comprises a single, unitary panel spanning in the longitudinal direction between opposing ends of the main body, however in other embodiments, the insert body comprises a plurality of sections abutted in series with one another along a length of the main body. In either instance, a bonding material preferably secures the insert body to the main body.

An upper surface of the insert body is typically substantially flush with the side portions at the top of the main body.

In some embodiments, the two side portions each define a mounting groove which is recessed laterally inwardly in relation to a respective side edge of the body so as to be arranged to receive respective portions of respective deck board mounting clips therein.

In other embodiments, one side portion of each deck board includes a fastener flange which permits fastening to the joist, while the other side portion is arranged to be interlocked with the fastened side portion of a previously installed deck board.

The frame portion of each deck board preferably includes an upper portion which defines a bottom wall of the recessed channel and a lower portion comprising a plurality of ribs depending downwardly from the upper portion at laterally spaced apart positions between the two side portions.

According to a second aspect of the present invention, there is provided in a deck structure comprising:

a plurality of joists; and a plurality of intermediate deck boards spanning longitudinally across the plurality of joists and defining an upper deck surface, each intermediate deck board including a top surface forming a respective portion of the upper deck surface, a bottom side below the top surface and engaged upon the joists, a first side portion spanning in a longitudinal direction of the intermediate deck board along a first side of the intermediate deck board and defining a female interlocking element formed thereon, a second side portion spanning in the longitudinal direction along a second side of the intermediate deck board opposite the first side and defining a male interlocking element arranged for interlocking connection with the female interlocking element of an adjacent one of the intermediate deck boards;

an improvement comprising an end deck board arranged to span across the plurality of joists at one end of the deck structure alongside a corresponding one of the intermediate deck boards, the end deck board including an interlocking element formed thereon which is arranged to mate in interlocking connection with the corresponding intermediate deck board independently of the male and female interlocking elements thereof so as to prevent relative uplift of the deck boards from the joists.

Preferably each intermediate deck board includes a fastener flange protruding outwardly from one of the side portions beyond the interlocking element of said one of the side portions at the bottom side of the intermediate deck board upon which the interlocking element of the end deck board is arranged to be mated in interlocking connection.

Preferably the end deck board includes a recessed area at the bottom side thereof which is arranged to receive the fastener flange of the corresponding intermediate deck board therein such that uplift of the corresponding intermediate deck board from the joists relative to the end deck board is prevented by the end deck board overlapping the fastener flange.

Preferably the fastener flange of each intermediate deck board includes a hook portion formed therein and the interlocking element of the end deck board is arranged to be hooked beneath the hook portion of the corresponding intermediate deck board such that uplift of the end deck board from the joists relative to the corresponding intermediate deck board is prevented by hooking of the interlocking element with the hook portion.

Preferably the end deck board has a top surface which is arranged to be flush with the top surface of the intermediate deck boards so as to form a respective portion of the upper deck surface and has a width which is substantially identical to a width of the top surface of the intermediate deck boards.

According to another aspect of the present invention there is provided in a deck structure comprising:

a base frame comprising a plurality of joists; and a plurality of intermediate deck boards spanning longitudinally across the plurality of joists and defining an upper deck surface, each intermediate deck board including a top surface forming a respective portion of the upper deck surface, a bottom side below the top surface and engaged upon the joists, a first side portion spanning in a longitudinal direction of the intermediate deck board along a first side of the intermediate deck board and defining a female interlocking element formed thereon, a second side portion spanning in the longitudinal direction along a second side of the intermediate deck board opposite the first side and defining a male interlocking element arranged for interlocking connection with the female interlocking element of an adjacent one of the intermediate deck boards;

an improvement comprising an end finishing board arranged to span across the plurality of joists at one end of the deck structure alongside a corresponding one of the intermediate deck boards, the end finishing board including:

an interlocking element formed longitudinally along one side thereof which is arranged to mate in interlocking connection with one of the interlocking elements on the corresponding intermediate deck board so as to prevent relative uplift of the boards from the base frame;

a bottom side arranged to be abutted against a top side of the base frame; and a depending flange extending downwardly from the bottom side along a length of the end finishing board so as to be arranged for abutment against an upright perimeter surface of the base frame.

Preferably the depending flange is substantially flush with an outermost upright side edge of the end finishing board.

Preferably the depending flange includes an undercut recess at an inner side adjacent a bottom thereof so as to be arranged to receive a top edge of an upright finishing panel therein.

Preferably the end finishing panel has a top surface forming a respective portion of the upper deck surface in which the top surface of the end finishing panel includes at least one fastener opening formed therein so as to be arranged to receive a fastener therethrough which secures the bottom side of the end finishing panel against the top side of the base frame.

Preferably said at least one fastener opening comprises a recessed mounting channel extending along a length of the end finishing panel.

When the end finishing panel has a top surface forming a respective portion of the upper deck surface, preferably the top surface of the end finishing panel including at least one recessed railing fastener channel extending along a length of the end finishing panel which is arranged to receive a threaded nut therein for longitudinal sliding along the end finishing panel.

The recessed mounting channel extending along a length of the end finishing panel is preferably in alignment below said at least one recessed railing fastener channel.

According to another aspect of the present invention there is provided in a deck structure comprising:

a base frame comprising a plurality of joists; and a plurality of intermediate deck boards spanning longitudinally across the plurality of joists and defining an upper deck surface, each intermediate deck board including a top surface forming a respective portion of the upper deck surface and a bottom side below the top surface and engaged upon the joists;

the improvement comprising a side finishing board arranged to span along one side of the deck structure against which ends of a plurality of the intermediate deck boards are abutted, the side finishing board including:

a top surface forming a respective portion of the upper deck surface;

a bottom side below the top surface and engaged upon the base frame;

an inner side wall against which the ends of the intermediate deck boards are arranged to be abutted; and a support flange protruding laterally from the inner side wall beyond an inner edge of the top surface at a location spaced below the top edge so as to be arranged to support the bottom side of the intermediate deck boards thereon.

Preferably the support flange of the side finishing board is spaced below the top surface of the side finishing board by a height of the intermediate deck boards such that the top surface of the side finishing board is arranged to be flush with the top surfaces of the intermediate deck boards.

Preferably the support flange of the side finishing board is offset below the bottom side of the side finishing board which is engaged upon the base frame such that a top side of the support flange is substantially coplanar a top side of the base frame supporting the intermediate deck boards thereon.

Preferably the side finishing board further comprises an inner depending flange depending downwardly from the bottom side of the side finishing board which is engaged upon the base frame so as to be arranged for fastening to an inner surface of an outermost one of the joists of base frame.

Preferably the inner side wall is offset towards an interior of deck structure relative to the inner depending flange.

Preferably the top surface of the side finishing panel includes at least one fastener opening formed therein so as to be arranged to receive a fastener therethrough which secures the bottom side of the side finishing panel against the top side of the base frame. Preferably said at least one fastener opening comprises a recessed mounting channel extending along a length of the side finishing panel.

The top surface of the side finishing panel may also include at least one recessed railing fastener channel extending along a length of the side finishing panel which is arranged to receive a threaded nut therein for longitudinal sliding along the side finishing panel.

The recessed mounting channel extending along a length of the side finishing panel is preferably in alignment below said at least one recessed railing fastener channel.

According to yet another aspect of the present invention there is provided a deck structure as described above in which each intermediate deck board comprises:

a main body which is elongate in a longitudinal direction, the main body including two side portions extending in the longitudinal direction along opposing sides of the body and a frame portion integrally joined between the side portions, the frame portion being recessed in height relative to the two side portions such that the two side portions and the frame portion define a recessed channel spanning in the longitudinal direction along a top of the main body; and an insert body received within the recessed channel in the top of the body and formed of a different material than the extruded body which defines a respective portion of the upper deck surface.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
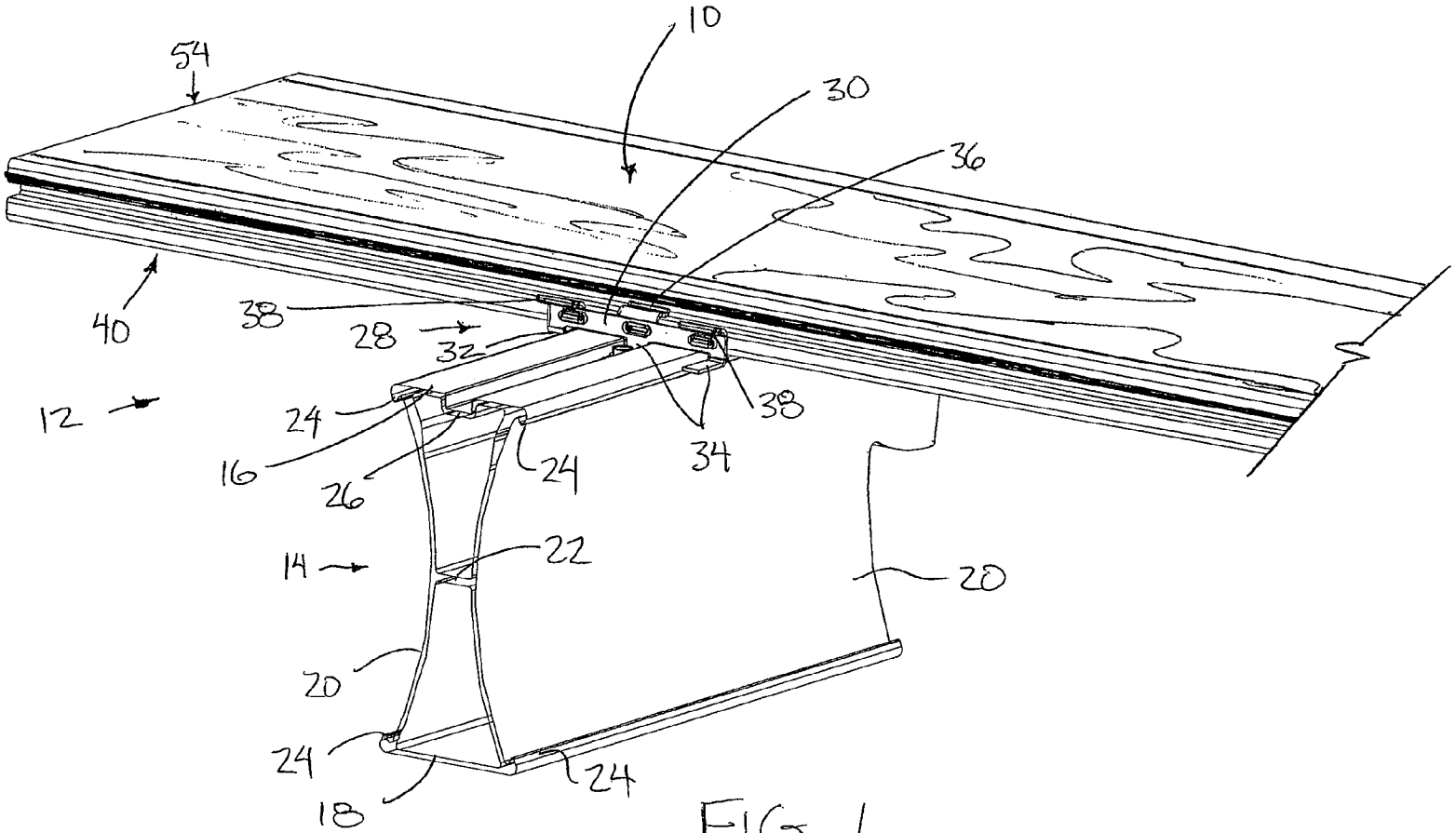
FIG. 1 is a perspective view of a first embodiment of the deck board secured across a joist using a mounting clip.

Referring to the accompanying figures, there is illustrated a deck board generally indicated by reference numeral 10. The deck board 10 is particularly suited for use in a patio deck system or structure 12 as described in the applicant's copending U.S. patent application Ser. No. 12/863,217, filed May 27, 2011 and U.S. patent application Ser. No. 13/968,043, filed Aug. 16, 2013 which are incorporated herein by reference.

The deck structure 12 in each instance generally includes a base frame formed of a plurality of elongate joists 14 which are mounted in parallel and spaced apart configuration to span the area of the deck. More particularly, the joists includes two outermost joists extending along opposing sides of the deck and a plurality of intermediated joists at spaced positions therebetween which spans between header members at opposing ends of the deck structure.

In some embodiments, the base frame components may be formed of dimensional lumber.

In the first illustrated embodiment the joists comprise extruded aluminum material. As shown in FIG. 1, in this instance each joist 14 includes a generally horizontal top plate 16 and a generally horizontal bottom plate 18 at opposing top and bottom ends of the joist. Two side walls 20 span the height of the joist between the top plate and the bottom plate at spaced apart positions to define laterally opposing sides of the joist. Each side wall has a concave outer surface such that the side walls are spaced apart at their greatest distance at the top and bottom plates while tapering inwardly towards one another from both opposing top and bottom ends towards the narrowest width at the vertical centre. An additional reinforcing web 22 is connected horizontally between the two side walls at the vertical centre. The remainder of the joist comprises a generally hollow core above and below the connector web 22. Each of the top and bottom plates protrudes laterally outward beyond the respective side walls 20 at both sides to define a hooked retainer edge 24 extending laterally outward and then protruding vertically inward at the free end thereof. A recessed channel 26 is also laterally centred in the top plate.

Also in the first embodiment, a plurality of mounting clips 28 are used to secure the deck boards 10 to the joists 14 respectively. More particularly, each deck board is secured along each of the two opposing sides thereof to each of the joists respectively using the mounting clips. Each mounting clip 28 includes a main body 30 spanning laterally across the top plate of the joist between the two opposing side edges of the joist. A hook portion 32 is formed at one end of the main body to depend downwardly and be hooked underneath a corresponding retainer edge 24 of the joist. Additional mounting flanges 34 depend downwardly from the main body adjacent the opposing retainer edge and at the central recessed channel 26 to further assist in securing the mounting clip relative to the joist. A fastener may be used to be fastened through the mounting flange aligned with the recessed channel 26 for fixing the mounting clip relative to the joist. Each mounting clip further includes at least one first retainer flange 36 extending outwardly in the longitudinal direction of the joist from one side of the main body and at least one second retainer flange 38 extending in the longitudinal direction of the joist outward from the opposing side of the main body of the mounting clip. The retainer flanges are thus suitably arranged to protrude into the side edges of respective ones of two adjacent deck boards which each clip retains relative to the joist as described in further detail below.

Turning now to the first embodiment of the deck board 10, each deck board is generally elongate in a longitudinal direction of the board for spanning across a plurality of the spaced apart joists. A main body 40 of the deck board comprises extruded aluminum. The extruded main body includes a first side portion 42, a second side portion 44, and a frame portion 46 spanning laterally between the two side portions at opposing sides of the board such that the side portions and the frame portion are all integral, seamless, and moulded together as a single unitary body by the extrusion process. Each of the side portions and the frame portion are continuous in the longitudinal direction of the board.

The first side portion 42 extends up to the top of the deck board at the first side of the deck board while the second side portion 44 extends up to the top of the deck board at the second side of the deck board so that the first and second side portions are similar in height. The frame portion however is recessed in height relative to both side portions between which it spans such that the two side portions and the frame portion therebetween collectively define a recessed channel 47 in the top of the deck board which is generally U-shaped.

More particularly, the frame portion 46 comprises an upper portion comprising a horizontal panel 48 defining a bottom wall of the recessed channel 47 with longitudinal grooves formed in the upper surface thereof. The frame portion further includes a lower portion 50 in the form of a plurality of laterally spaced apart ribs 52 extending vertically downward from the bottom side of the panel 48. The ribs all extend downward to a bottom free end terminating in a common plane at the bottom side of the deck board for being engaged upon the top plate of the joists in a mounted position.

An insert body 54 of the deck board is received within the recessed channel 47 in the main body 40. The insert body is generally planar in shape and is comprised of a rigid, unitary material which is different from the material of the main body 40. For example, the insert body may comprise an extruded plastic panel formed as a unitary body spanning the full length of the deck board in the longitudinal direction. Alternatively, the insert body may comprise ceramic materials which is similarly unitary to span the full length, or alternatively formed in sections mounted in series with one another in the longitudinal direction to fully occupy the recess along the full length and width of the deck board.

The insert body 54 is mounted within the recessed channel in the main body such that an upper surface of the insert body is flush at the top with the first and second side portions 42 and 44. The insert body thus defines the finished exposed material at the top of the assembled deck board.

Typically, the insert body 54 is secured within the recessed channel using a suitable bonding material which is adhesively secured to the longitudinal grooves in the upper surface of the upper portion 48 of the main body.

The deck boards are arranged to interlock with one another and with the mounting clips 28 by the configuration of the first and second side portions.

The first side portion 42 of each deck board includes an upright flange 56 extending vertically upward from the respective side of the horizontal panel 48 of the main body. A top flange 58 extends horizontally outward from the top end of the upright flange 56 to define the top side of the first side portion 42 which is flush with the upper surface of the insert body 54.

An outermost one of the vertical ribs 52 forms part of the first side portion and extends vertically downward from the horizontal panel 48 to be coplanar with the upright flange 56 thereabove. A lower flange 60 extends laterally outward from an intermediate location along the vertical rib 52 below the height of the panel 48 but spaced above the bottom side of the deck board.

The lower flange 60 defines a bottom boundary of a mounting groove 62 which receives the retainer flanges of corresponding mounting clips 28 therein. Engagement of the mounting flanges on the top side of the lower flange 60 serves to hold down the deck board against the joists.

An outer depending flange 64 extends vertically downward from the outer end of the lower flange 60 to the bottom side of the deck board to provide additional support to the lower flange against which the retainer flanges of the mounting clips are engaged.

An upper boundary of the mounting groove 62 is defined by a shoulder 66 which protrudes laterally outward from the rib 52 above the groove. The shoulder 66 forms a stepped profile together with the top flange 58 thereabove.

The recessed area below the top flange which is laterally outward in relation to the shoulder 66 and which is above the mounting groove 62 defines a female recess 68 or female interlocking element. The female recess 68 is arranged to cooperate with a corresponding male protrusion 70 or male interlocking element on the second side portion of an adjacent deck board of like configuration as described in further detail below. Accordingly the male and female interlocking elements form an interlocking connection which prevents uplift of the deck boards relative to one another from the joists.

A gasket 72 is also received in the female recess 68 in the form of elongate strip of resilient material retained between the shoulder 66 and the top flange 58 within a respective undercut area of the top flange 58.

The second side portion 44 of each deck board similarly includes an upright flange 74 extending upward from the respective side of the panel 48 forming the upper portion of the main body such that the upright flange 74 defines the top of the deck board at the respective second side. The male protrusion 70 comprises a horizontal flange which protrudes laterally outward from the bottom of the upright flange 74 so as to be substantially coplanar with the panel 48 forming the upper portion of the main body.

A mounting groove 76 is defined immediately below the male protrusion 70 as a laterally inward recess which extends laterally inward beyond the upright flange 74 thereabove. The upper boundary of the mounting groove is thus defined in part by the male protrusion 70 and in part by the bottom side of the panel 48 of the frame portion of the main body.

The second side portion 44 also includes a lower flange 78 protruding laterally outward from an outermost one of the vertical ribs 52 at the second side portion to define a lower boundary of the mounting groove 76. Similarly to the lower flange 60 of the first side portion 42, the lower flange 78 at the second side portion 44 defines the horizontal surface upon which respective retainer flanges of the mounting clips are engaged to retain the deck board to the joist at the second side of the deck board.

An outer depending flange 80 also extends vertically downward from the outer edge of the lower flange 78 to the bottom side of the deck board to provide additional support to the lower flange.

In a mounted position of the deck boards, the outer depending flanges 64 and 80 of two adjacent deck boards abut opposing sides of the main bodies 30 of the mounting clips therebetween such that the main bodies 30 of clips act as a spacer between the pair of depending flanges.

In this abutted position, the retainer flanges 36 and 38 of the mounting clips protrude into the respective mounting grooves at the first and second side portions of the adjacent deck boards to engage the top side of the lower flanges 60 and 78 to retain the deck boards secured against the joists.

Also in this mounted position, the male protrusion 70 at the second side portion 44 of one deck board overlaps in the lateral direction below the top flange 58 at the first side portion 42 of the adjacent deck board sufficiently that the male protrusion abuts the gasket 72 within the undercut area below the top flange. The gasket 72 thus provides a sealing engagement between the adjacent deck boards along the full length thereof in the longitudinal direction.

Furthermore, in this arrangement any gap between the upright flange 74 at the second side portion of one deck board and the outer edge of the top flange 58 at the first side portion of an adjacent deck board is overlapped therebelow by the horizontal flange of the male protrusion 70 so that the mounting clips are not visible from above through the gap between adjacent deck boards.

The deck boards are typically installed by initially securing a first deck board along one side of the deck structure to span across the top of the joists perpendicularly thereto. A first row of mounting clips is then secured by securing one clip to each joist in a single row along the innermost side edge of the first deck board by securing the mounting clips to the joist in the manner describe above while ensuring the respective retainer flanges are retained within the mounting grooves in the corresponding side portion of the first deck board.

A second deck board is then mounted across the joists by inserting the corresponding retainer flanges of the installed mounting clips into the mounting groove at the respective side portion of the second deck board. The first and second deck boards are abutted adjacent one another with the main bodies 30 of the mounting clips acting as a spacer between the depending flanges 80 and 64 and with the male protrusion 70 of one board being received within the female recess 68 of the other board. The gasket 72 is engaged between the deck boards to form a sealing connection in the longitudinal direction along the full length of the deck boards.

The second deck board is then similarly secured at the opposing side edge by another row of mounting clips mounted to the joists respectively. The remainder of the deck structure is then similarly assembled by engaging a deck board with a previously installed deck board and the mounting clips along its exposed edge, followed by securing the opposing edge of the newly placed deck board with another row of mounting clips.

Figure 2:
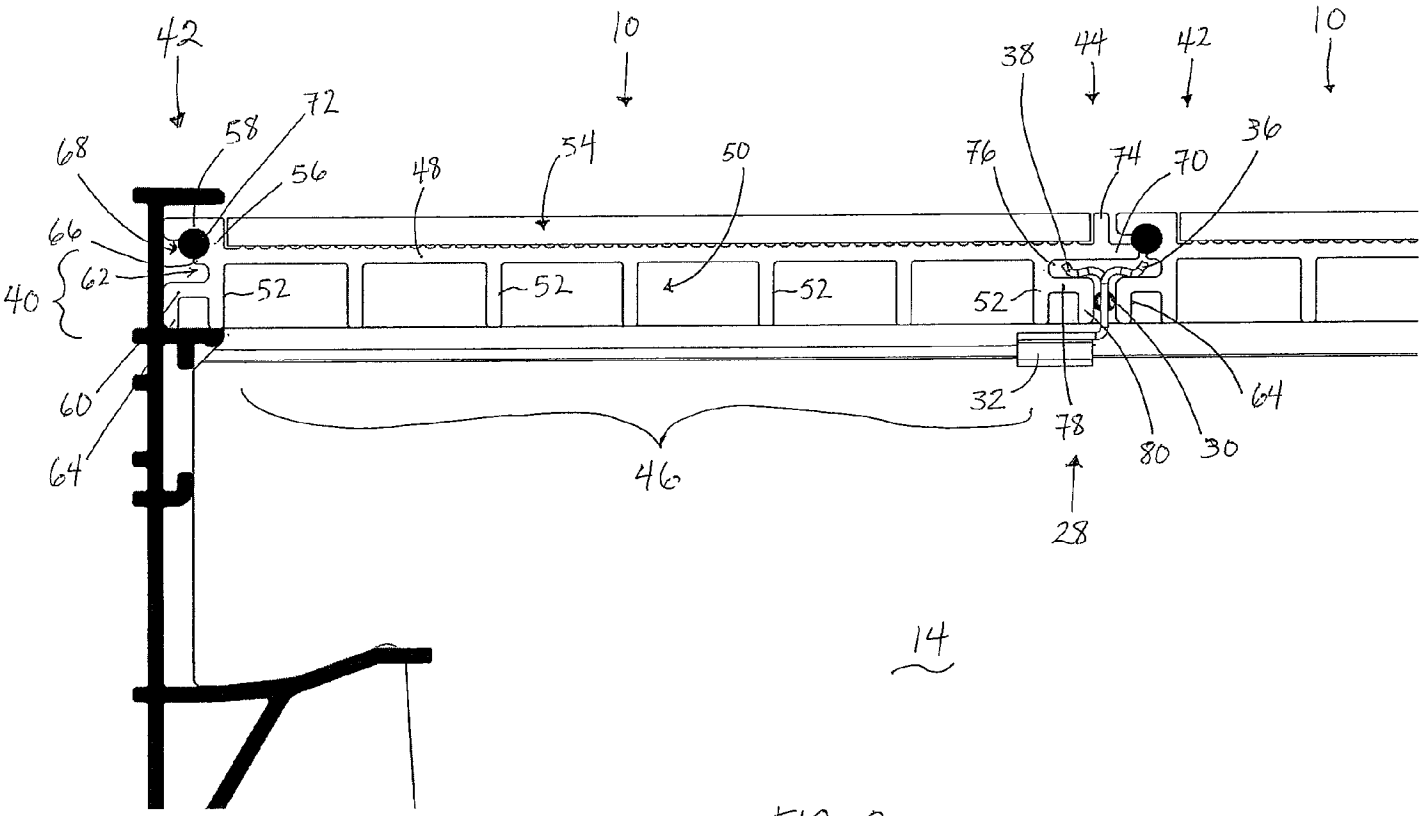
FIG. 2 is a sectional end view of the deck board according to the first embodiment of FIG. 1.
Figure 3:
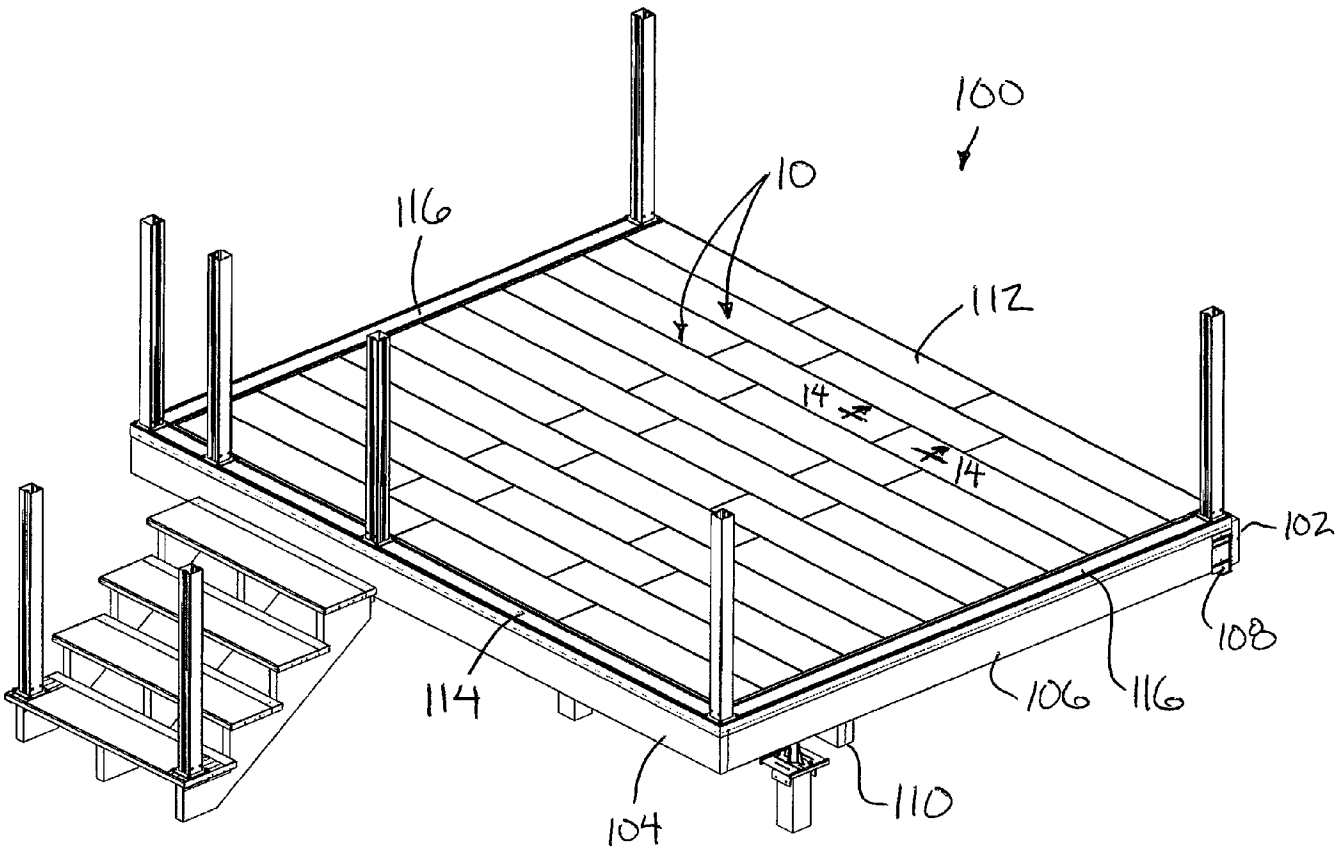
FIG. 3 is a perspective view of an alternate decking system using a second embodiment of the deck board.
Figure 4:
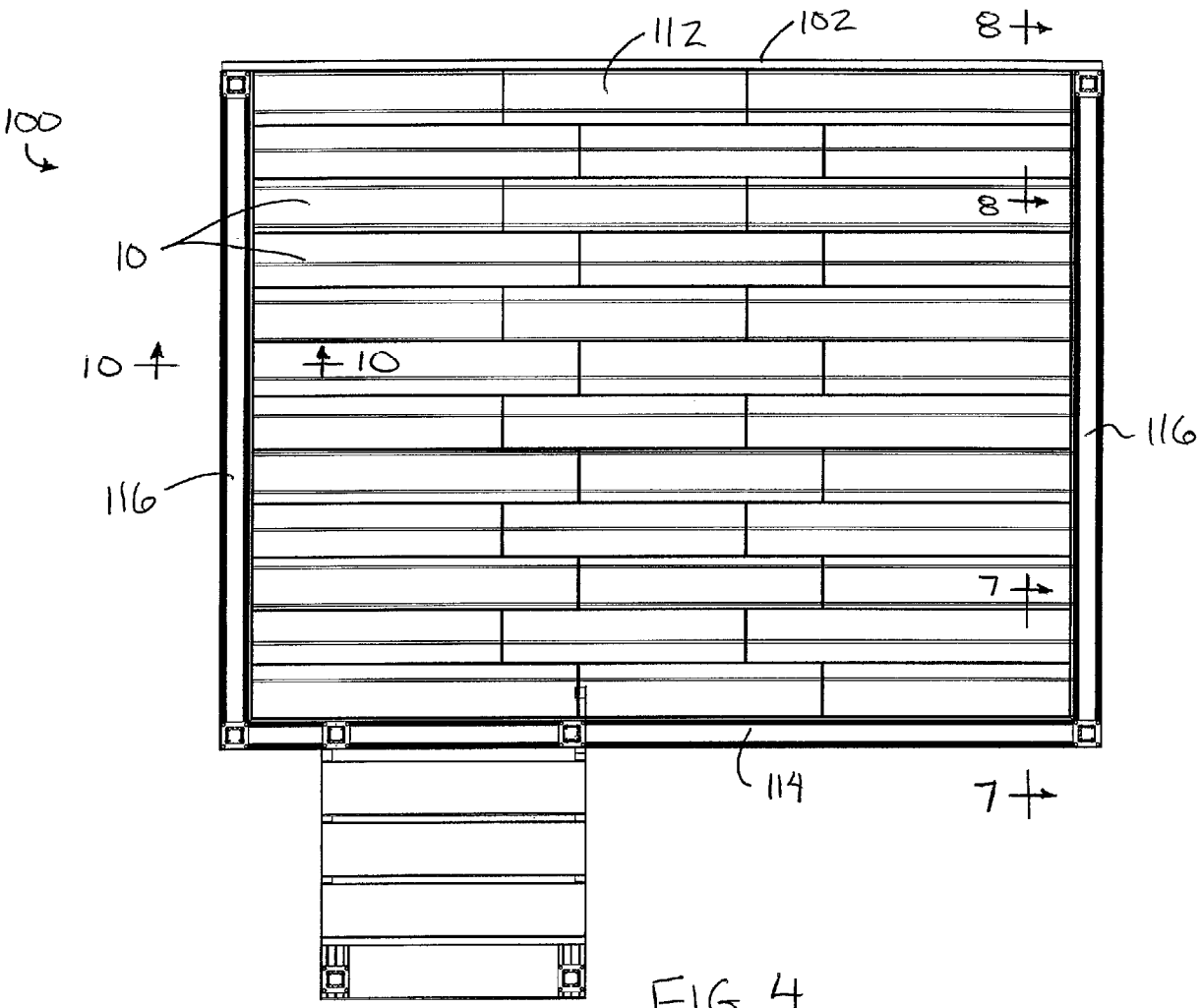
FIG. 4 is a top plan view of the decking system according to the second embodiment of FIG. 3.

In further embodiments, the same deck boards 10 of FIGS. 1 and 2 can be readily secured to other types of joists, including commercially available dimensional lumber, but using suitable mounting clips that can be fastened to the respective joists. In this instance, the clips would similarly be provided with retainer flanges received within the mountings grooves of the deck boards as described above to complete securement of the deck boards to the joists.

Referring now to FIGS. 3 through 13, a second embodiment of the intermediate deck board 10 will now be described for use with an alternate decking system 100.

Similar to the previous embodiment, the decking system in this instance includes a base frame formed of a ledger board 102 typically secured against an existing building structure. In the illustrated embodiment, the ledger board comprises an extruded metal channel, however in further embodiments, the ledger board may comprise dimensional wood lumber. The ledger board defines an inner end of the assembled deck structure opposite a footer member 104 extending across the opposing outer end of the deck. The footer member comprises dimensional wooden lumber.

A plurality of joists 106 of the base frame are mounted to span longitudinally between the ledger board 102 at the inner end and the footer member 104 at the outer end at parallel and laterally spaced apart positions between two opposing sides of the deck structure. Two outermost ones of the joists 106 define the laterally opposed sides of the deck which span longitudinally between the inner and outer ends. The joists 106 may be attached to hanger brackets 108 at the inner end for interlocking or hooking connection onto the extruded ledger board 102. At the opposing end, the outer ends of the joist are fastened to the footer member, for example by traditional means including nails or threaded fasteners such as screws and the like.

The joists are supported towards the outer ends thereof on a beam spanning laterally across all of the joists upon which the joists are engaged so that the base frame is generally horizontal in orientation or at a slight incline to assist in shedding of water. The beam 110 is parallel to the ledger board and is supported on posts to be spaced above the ground.

Figure 7:
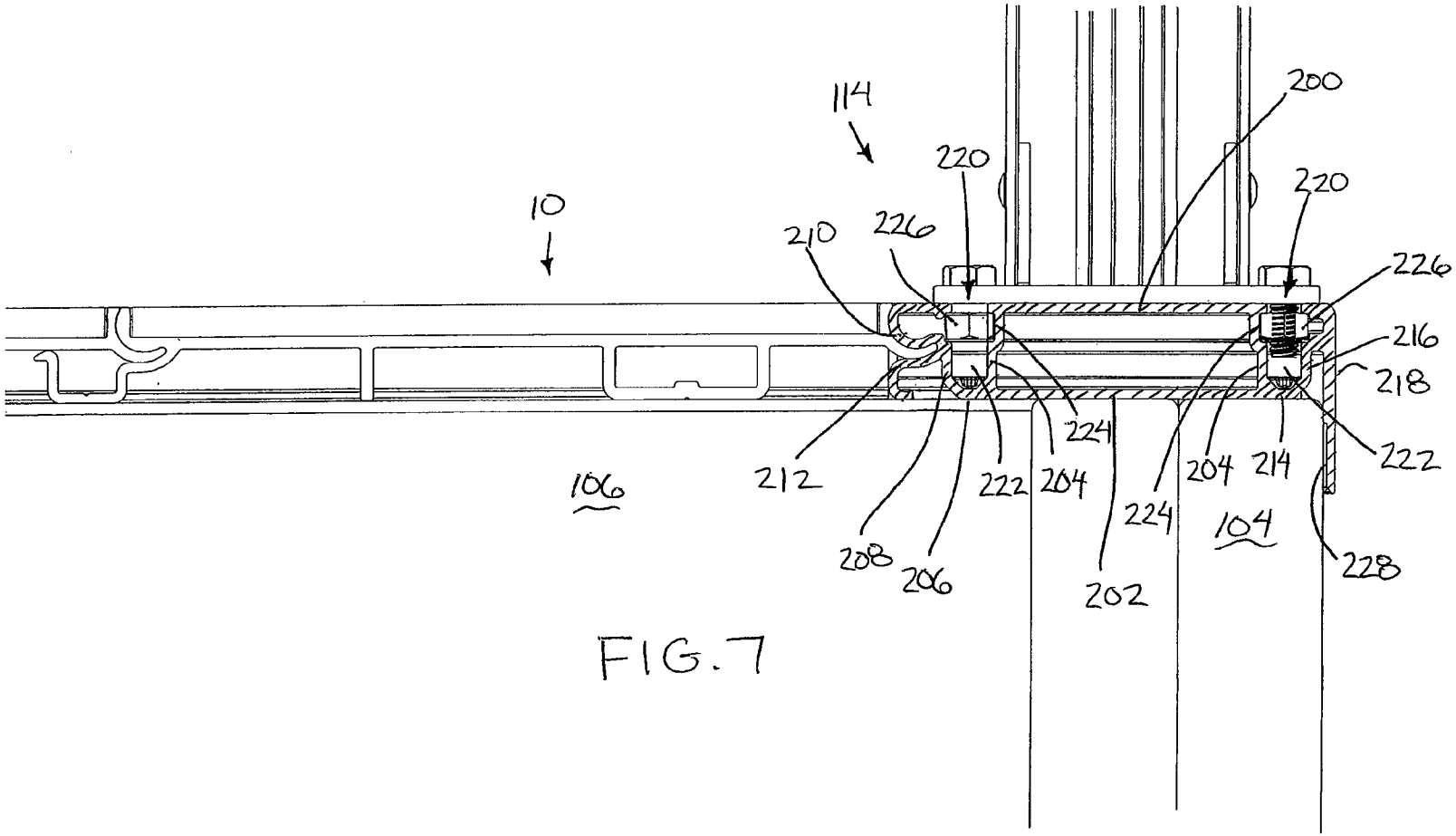
FIG. 7 is a cross sectional view along the line 7-7 of a portion of the decking system shown in FIG. 3 which illustrates an end view of an end finishing board.
Figure 8:
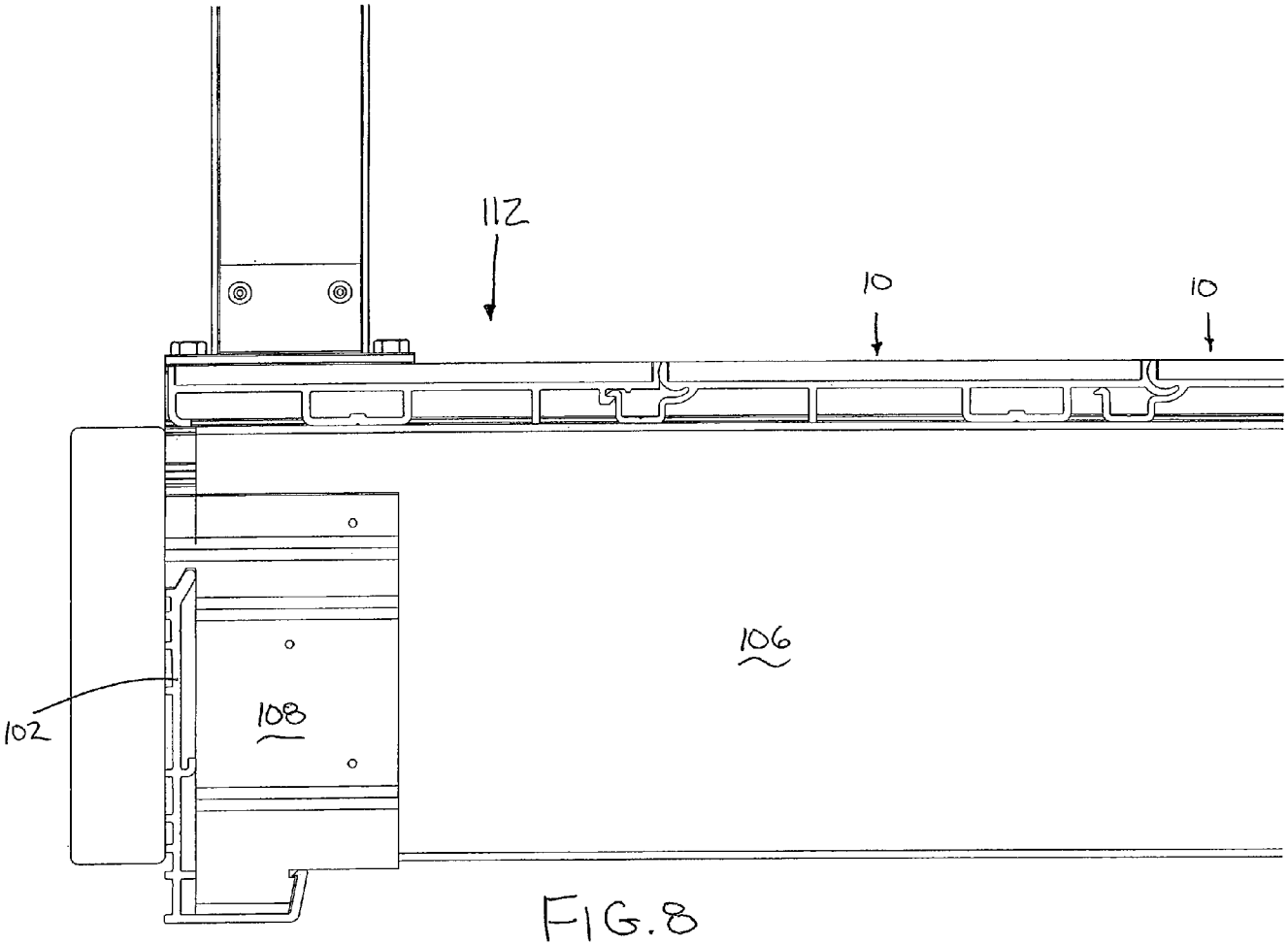
FIG. 8 is a cross sectional view along the line 8-8 of a portion of the decking system shown in FIG. 3 which illustrates an end view of an inner end deck board.
Figure 9:
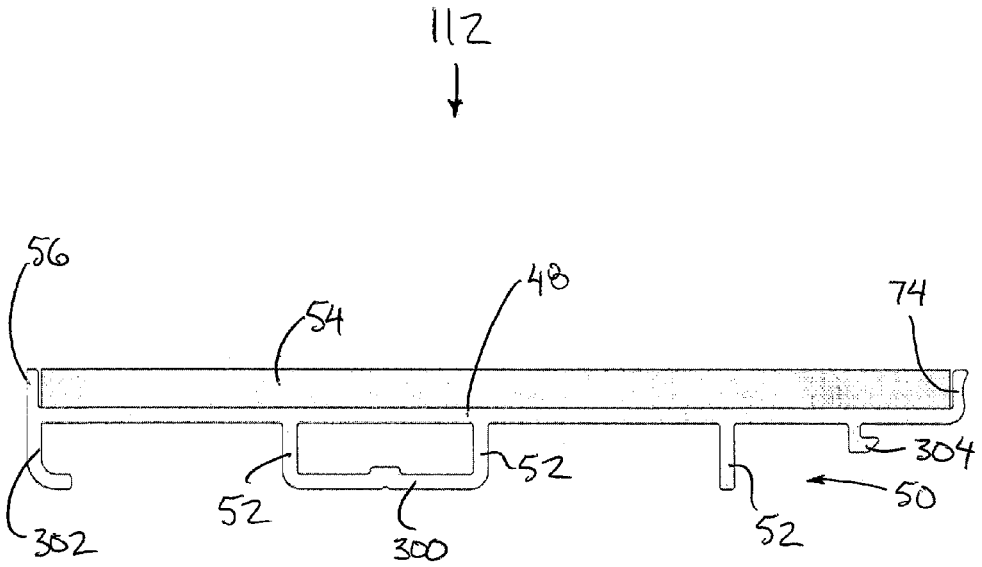
FIG. 9 is an end view of the end deck board of FIG. 8 shown removed from the decking system.
Figure 10:
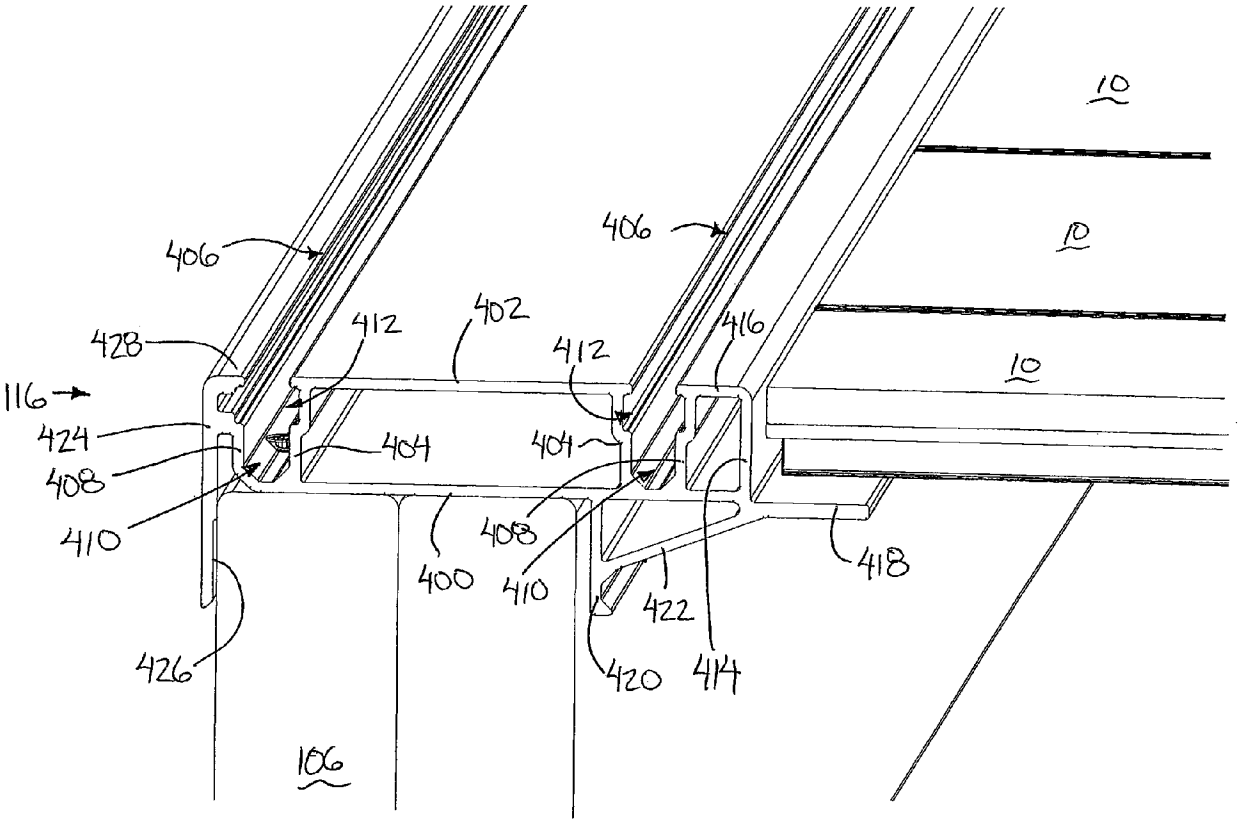
FIG. 10 is a cross sectional view along the line 10-10 of a portion of the decking system shown in FIG. 3 which illustrates an end view of a side finishing board.

The deck board 10 according to the second embodiment cooperates with various additional components which collectively define an upper deck surface of the assembled deck structure. The additional components include an end deck board 112 engaged upon the inner end of the base frame and which is illustrated in FIGS. 8 and 9. The additional components also include an end finishing board 114 engaged upon the base frame at the outer end of the deck structure as shown in FIG. 7 and a side finishing board 116 engaged upon the base frame along laterally opposed sides of the deck structure as shown in FIG. 10. Each one of the intermediate deck boards 10, the end deck board 112, the end finishing board 114, and the side finishing boards 116 each define a respective portion of the upper deck surface of the assembled deck structure.

Figure 5:
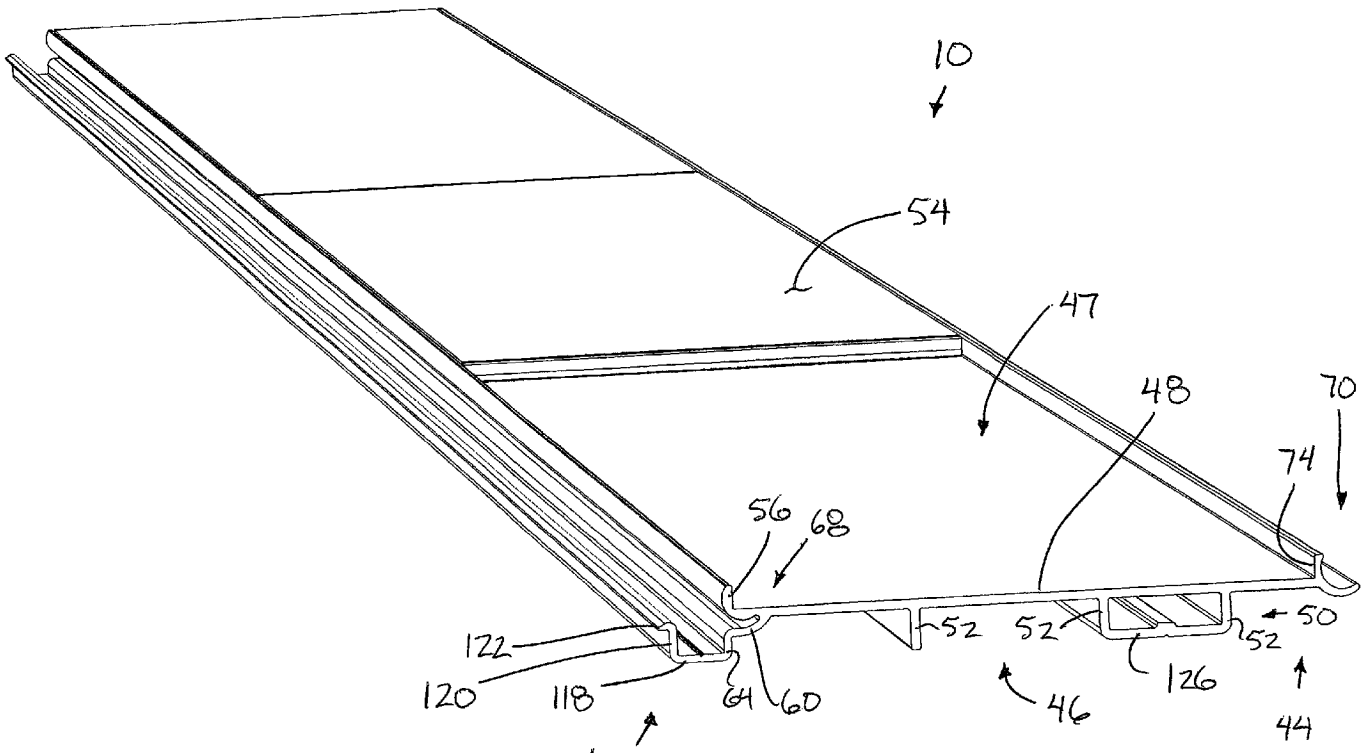
FIG. 5 is a perspective view of a single deck board according to the second embodiment of FIG. 3 with some of the insert material shown removed.
Figure 6:
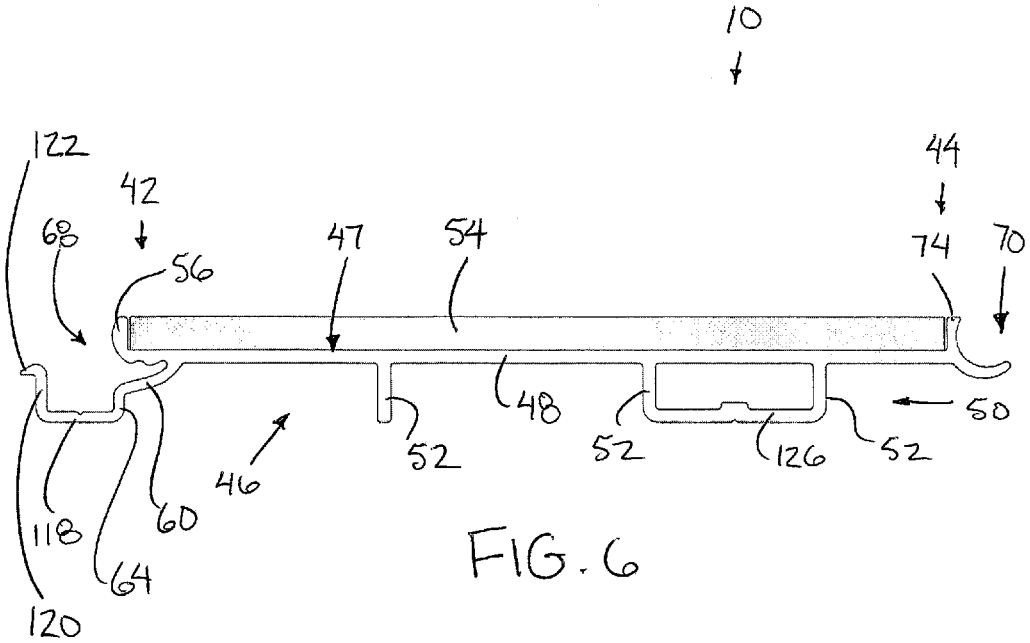
FIG. 6 is an end view of the deck board according to the second embodiment of FIG. 3.

The deck board 10 according to FIGS. 5 and 6 is similar to the first embodiment of the deck board in many aspects in that the deck board includes a frame portion formed of extruded aluminum which is uniform in cross section and profile along the length thereof between longitudinally opposed ends. The resulting deck board is accordingly elongate in the longitudinal direction between the opposed ends. More particularly, the frame portion 46 extends between a first side portion 42 and a second side portion 44. The frame portion includes an upper portion comprised of a horizontal panel 48 which spans between the upright flange 56 at the first side and the upright flange 74 at the second side so that the upright flanges form a U-shaped recess 47 with the horizontal panel 48 which is suitable to receive the insert body 54 therein similarly to the previous embodiment. The insert body 54 is a unitary material bonded within the recessed channel 47 so as to be flush with the top edges of the upright flanges 56 and 74 as described above with regard to the first embodiment.

As best shown in FIG. 5, the insert body 54 comprises a plurality of sections which are substantially abutted in series with one another in the longitudinal direction. In the illustrated embodiment, the sections of the insert body comprise ceramic tiles in which each adjacent pair of tiles are separated by a spacer element 105 formed of a different material. In the preferred embodiment, the spacer element 105 is an aluminum extruded channel having an appearance which is similar to various conventional aluminum trim members used in the ceramic tile industry to provide a finished trim about edges of ceramic tiles. The spacer element is more resilient than the ceramic tiles so as to prevent chipping of the ends of the ceramic tiles when the deck board undergoes slight flexing in use.

In many instances, each deck board spans the full width of the deck between the outermost joists at opposing sides of the deck structure with the spacer elements 105 being abutted in series between the tile sections of a common deck board.

Figure 14:
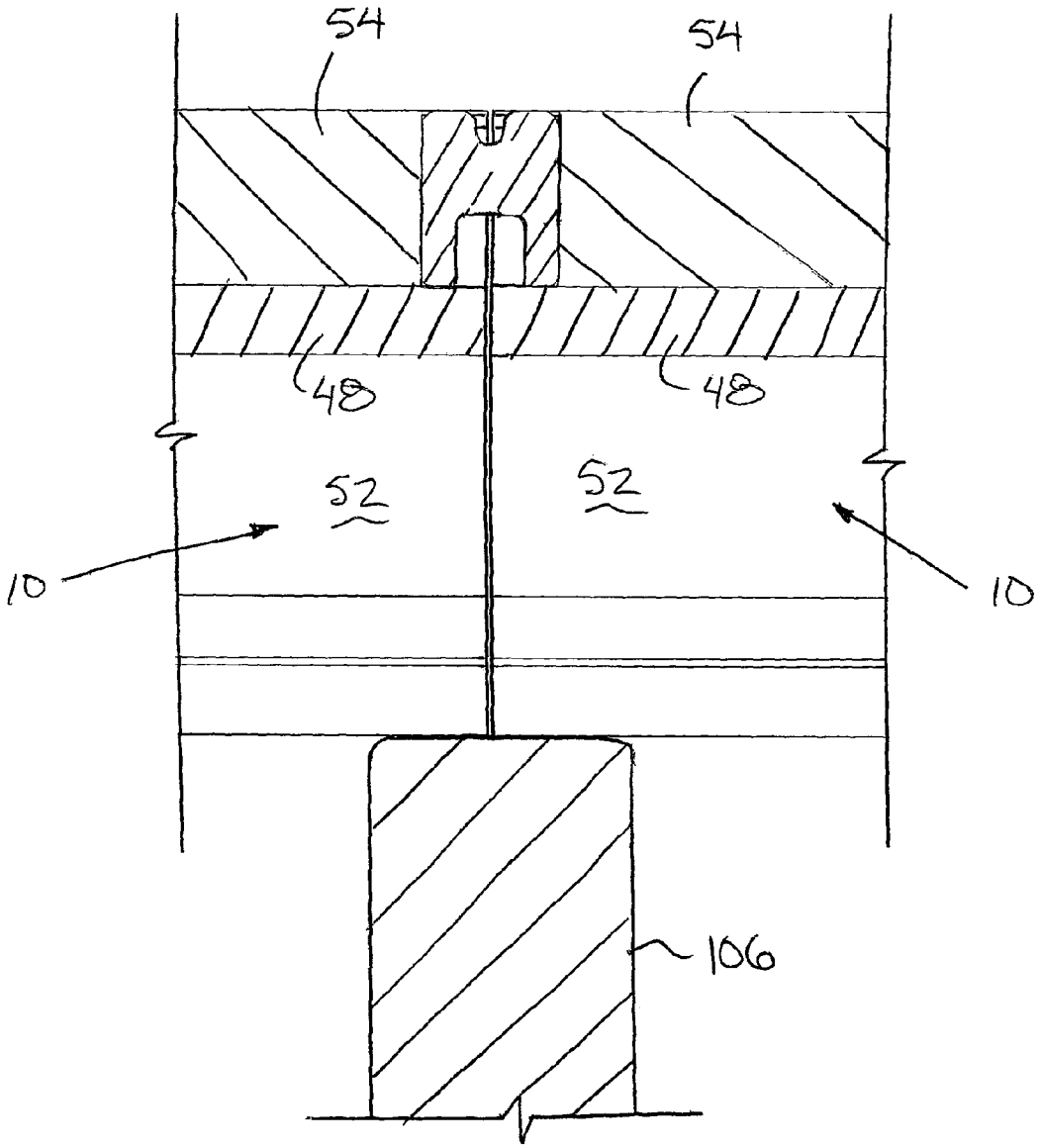
FIG. 14 is a sectional view along the line 14-14 of FIG. 13, illustrating a spacer element abutted in series between the ceramic tile insert bodies of two deck boards.

In the instance of larger deck structures however, each row of the assembly deck structure may comprises two or more deck boards 10 abutted in series with one another. As shown in FIG. 14, two deck boards 10 are shown abutted in series with one another so that each overlaps a portion of a common joist 106 therebelow. The ends of the ceramic tile insert bodies 54 are recessed relative to the ends of the deck boards by approximately half of the width of the spacer element 105 so that the spacer element 105 can be abutted between the ends of the ceramic tile insert bodies 54 when the ends of the frame portions of the deck boards 10 are abutted therebelow.

Furthermore, each deck board 10 includes a female element 68 formed at the first side as defined by a lower flange 60 joined to the underside of the horizontal panel 48 adjacent the first end thereof. The lower flange 60 extends outward to an outer edge terminating in line with the upright flange 56 thereabove. The lower flange 60 is spaced below the horizontal panel 48 such that a resulting groove is defined between the lower surface of the horizontal panel 48 and the upper surface of the lower flange 16 to define the female element 68.

An outer depending flange 64 depends downwards from the lower flange 60 to terminate at the bottom side of the overall deck board 10. A fastener flange 118 extends laterally outward from the bottom end of the depending flange 64 to extend laterally outward beyond the side edges of the panel 48 and the upright flange 56 at the side edge of the panel 48, while being flush with the bottom side of the deck board 10 at the bottom side thereof. An upstanding flange 120 extends upward from the outer edge of the fastener flange at a location spaced laterally outwardly relative to the first side of the panel 48 locating the first flange 56 thereon and which further includes a hook formation 122 at the top end thereof which is near in elevation to the bottom side of the horizontal panel. The hook element 12 is arranged for mating connection with a portion of the end deck board 112 of FIGS. 8 and 9 as described in further detail below. The height of the upstanding flange 120 on a first deck board corresponds to a height between the bottom side of the panel 48 from the bottom side of the deck board at the second side 44 of the deck board such that the top side of the upstanding flange 120 engages the bottom side of the panel 48 of an adjacent deck board coupled alongside the first deck board. A longitudinal groove 124 is provided at a laterally centered location in the top surface of the fastener flange 118 to guide the insertion of fasteners inserted through the fastener flange from the top side thereof for fastening to the elements of the base frame upon which the deck board is engaged in a mounted position.

The frame portion of the deck board 10 also includes a lower portion 50 comprised of a plurality of ribs 52 similarly to the first embodiment. Each of the ribs 52 extends vertically downward from the bottom side of the horizontal panel 48 to terminate at a bottom end at the bottom side of the deck board flush with the bottom side of the fastener flange 118. The ribs are provided at laterally spaced apart positions from one another and from the opposing sides of the horizontal panel 48. More particularly, two ribs adjacent one another and nearest to the second side portion are joined by a respective bottom flange 126 which provides an additional surface for fastening the deck board to the base frame therebelow in certain applications. An additional rib 52 is provided at an evenly spaced position between the two connected ribs and the opposing first side portion of the horizontal panel 48.

The second side portion of the deck board 10 includes a male element 70 formed thereon to extend laterally outward from the second side of the horizontal panel 48 at the bottom of the upright flange 74. The outer side of the upright flange 74 is generally concave with a continuous radius of curvature with the top side of the male element 70 so that the resulting flange defining the male element is curved in profile. The bottom side of the flange forming the male element is accordingly convex.

The male element 70 is shaped to cooperate with a similarly curved profile of the groove forming the female element 68 at the first side of the deck board. More particularly, the outer side of the upright flange 56 at the first side and the bottom side of the horizontal panel 48 which forms the upper boundary of the female groove 68 together have a continuous concave surface of substantially constant radius of curvature matching the radius of curvature of concave surfaces at the second side portion of the deck board. In this manner, the male element 70 can be partially inserted into the female element of a previously installed deck board when the previously installed deck board is horizontal and the deck board to be installed is oriented at a downward inclination from the first side portion to the second side portion thereof. Pivoting the deck board being installed about a pivot axis defined at the center of the radius of curvature of the male and female elements permits the male element to be fully interlocked into a finished mounting position into the already installed deck board.

Before mounting a first one of the intermediate deck boards 10, the end finishing board 114 is mounted at the outer end of the base frame to form a starter board. The end finishing board 114 has a main body comprised of extruded aluminum which is continuous in cross section and profile along the length thereof in a longitudinal direction between opposing ends. The profile of the main body includes a main channel defined between a top wall 200 defining most of the top surface of the end finishing board, and a bottom wall 202 partly defining the bottom side of the end finishing board which is engaged directly upon the top side of the base frame. Two inner walls 204 extend between the top wall and bottom wall at laterally spaced apart positions towards opposing inner and outer sides of the finishing board 114.

At the inner side, a bottom flange 206 extends laterally outward beyond the respective inner wall 204, continuous with the bottom wall 202 at the bottom side of the channel. An outer wall 208 extends vertically upward from the bottom flange 206 at a location spaced outwardly from the respective inner wall 204. The outer wall 208 extends partway up the height of the profile to an upper flange 210 extending laterally outward from the outer wall at a first intermediate height. A lower flange 212 extends laterally outward from the outer wall 208 at a location spaced below the upper flange such that the upper flange 210 and the lower flange 212 define respective upper and lower boundaries of a female element which is curved in profile by the convex bottom side of the upper flange 210 and the concave top surface of the lower flange 212. The resulting female element which is open to the inner side of the profile is suitably arranged for mating connection with the male element of one of the intermediate deck boards coupled thereto in a manner which is substantially identical to the mounting of any one of the intermediate deck boards to a previously installed intermediate deck board as described above.

The end finishing board of FIG. 7 is further arranged such that the free end of the upper flange 210 extends upward to the top side of the profile and terminates at a horizontal portion which is coplanar with the top wall 200 to define a portion of the top surface of the end finishing board which in turn defines a portion of the resulting upper deck surface which is flush with the top surface of the intermediate deck boards 10. The lower flange 212 extends downwardly at the free end thereof along the inner side of the profile of the end finishing board to terminate at the bottom side flush with the bottom wall 202 to engage the top side of the base frame and provide further support.

At the outer side of the end finishing board, the profile similarly includes a bottom flange 214 extending horizontally outward continuous with the bottom wall 202 to an outer wall 216 extending upward therefrom at a location spaced laterally outward from the respective one of the inner walls 204. An outer side member is joined to the exterior of the outer wall 216 which is vertically oriented at the outer surface thereof. The outer side member 218 extends vertically downward below the bottom side of the bottom wall 202 of the profile to define a depending flange which is suitably oriented to extend downward along an outer upright perimeter surface of the footer member. The top end of the outer side member 218 extends to the top end of the profile and forms a portion of the top surface of the end finishing board which is flush with the top wall 200 at a location spaced laterally outward therefrom.

The resulting structure of the profile defines two openings 220 in the top side thereof in the form of parallel and laterally spaced apart slots spanning the full length of the end finishing board. One of the openings is defined between the top wall 200 and the upper flange 210 at the inner side of the profile, while the other opening 220 is defined between the top wall and the top end of the outer side member 218 at the outer side of the profile. Each opening 220 is aligned with a respective cavity in the profile therebelow which is defined between a respective one of the inner walls 204 and a respective one of the outer wall 208 or 216 at the inner and outer sides of the deck board respectively.

Each open cavity includes a lower portion 222 where the inner and outer walls are spaced apart by a first distance defining a mounting fastener channel suitable to provide access for insertion of fasteners downwardly through the openings 220 and open cavities for piercing through the corresponding bottom flanges 206 or 214 for fastening the bottom side of the profile to the top side of the base frame upon which the end finishing board is installed. The upper surface of the respective bottom flange spanning between one of the inner walls 204 and the respective outer wall has a generally tapered V-shape to assist in alignment of fasteners with a center of the mounting fastener channel.

An upper portion of each open cavity is arranged such that the inner walls 204 and the corresponding outer walls 208 or 216 are stepped in profile to be spaced apart by a greater lateral distance defining a railing fastener channel above the mounting fastener channel of the lower portion. Within each upper portion 224 of the cavity, a plurality of fastening nuts 226 are received such that the nuts are non-rotatable but longitudinally slidable along the length of the profile. The nuts 226 are internally threaded for accepting the threaded shaft of fasteners which clamp various accessory components including posts for a railing system against the top surface of the finishing board which in turn forms part of the upper deck surface of the assembled deck structure.

In use, the end finishing board 114 of FIG. 7 is first installed by engagement of the bottom side of the bottom wall thereof against the top side of the base frame along the full width of the footer member. The depending flange defined by the bottom end of the outer side member 218 is abutted against the upright perimeter surface defined by the footer member. An undercut area 228 is provided at the inner surface of the outer side member 218 at a location spaced below the bottom wall 202 in which the undercut area provides a suitable dimensioned recess to accommodate receiving the top edge of a finishing sheet inserted therein. The finishing sheet typically comprises steel flashing and the like mounted to the upright perimeter surface of the footer member for being overlapped at the top end thereof by the depending flange formed by the outer side member 218 respectively.

Screws are inserted downwardly through the openings 220 at spaced apart positions along the length of the end finishing board. Within the mounting fastener channel closest to the outer side of the profile, the fasteners are penetrated through the bottom of the profile for threaded connection to the footer member therebelow. Within the mounting fastener channel 222 nearest the inner side of the end finishing board, the fasteners are typically penetrated through the bottom side of the profile at spaced positions corresponding to the location of the joists respectively for penetrating the fasteners into the joists. The nuts are longitudinally slidable within the respective railing fastener channels to position the nuts at the desired mounting locations for railing posts and the like.

Once the end finishing board is installed, the first intermediate deck board 10 is installed by mating male and female interlocking connection. Upon rotating each intermediate deck board to its mounted position, fasteners are penetrated down through the fastener flange 118 thereof to secure the intermediate deck board in place. Intermediate deck boards are installed sequentially from the outer end of the deck structure towards the inner end of the deck structure.

At the inner end of the deck structure, the final intermediate deck board is secured in place using the end deck board 112 of FIGS. 8 and 9. The end deck board 112 is substantially like the intermediate deck boards 10 in that the end deck board is provided with a frame portion spanning between a first side portion and an opposing second side portion, however, the side portions are different in configurations. The frame portion however again comprises an upper portion formed of a horizontal panel 48 with an upper flange 56 extending upwardly therefrom at the first side and another upright flange 74 extending upward from the panel 48 at the second side to define a recessed channel 47 which is identical to the recessed channel of the intermediate deck boards to receive one or more insert bodies 54 therein as described above. Also similar to the above embodiment, the outer side of the upright flange 74 at the second side is concave for mating connection with the convex shape of the upright flange 56 of an adjacent intermediate deck board 10 against which the end deck board is abutted in the mounted position of FIG. 9.

The frame portion of the end deck board 112 also includes a plurality of ribs 52 extending downward from the bottom side of the horizontal panel 48 to terminate at respective bottom ends defining a common bottom side of the deck board which is engaged upon the top side of the joists of the base frame of the deck structure. The end deck board differs from the intermediate deck boards in that no male or female interlocking elements are provided.

Furthermore, two of the ribs 52 towards the first side are connected together by a bottom flange 300 to provide a fastening surface for fastening to the base frame as desired. An additional rib 52 between the two ribs joined by the bottom flange 300 and the second side of the profile terminates at a free end for engagement upon the top side of the base frame. An additional depending flange 302 is provided at the first side in vertical alignment with the upright flange 56 thereabove. The bottom free end of the depending flange 32 is curved inwardly towards the opposing second side of the end deck board.

Interlocking connection between the end deck board and the last one of the intermediate deck boards is provided by a hook element 304 which depends from the bottom side of the panel 48 at a location in proximity to but spaced inwardly from the second side of the panel 48. The space between the hook element and the second side of the panel corresponds approximately to the lateral width of the fastener flange of the intermediate deck boards 10. Accordingly, when the second side of the end deck board is abutted against the first side of the adjacent intermediate deck board 10, the hook element 122 of the upstanding flange 120 of the intermediate deck board is arranged to be aligned with and interlockingly engaged with the hook element 34 of the end deck board.

The interlocking connection is such that the hook element 304 of the end deck board is hooked beneath the hook element of the intermediate deck board so that fastening of the intermediate deck board to the base frame therebelow prevents uplift of the end deck board and relation thereto. The height of the upstanding flange 120 of the intermediate deck board however, is arranged to abut the bottom side of the horizontal panel 48 of the end deck board 112 in the mounted position such that fastening of the end deck board is in turn arranged to prevent uplift of the inner end of the adjacent intermediate deck board 10 in relation thereto.

Installation of the end deck board typically occurs simultaneously with the last one of the intermediate deck boards 10. More particularly, with the last intermediate deck board in a partially mounted position at a downward incline from the first side to the second side thereof where the male element is only partially engaged with the female element of the previously installed intermediate deck board, initial engagement of the end deck board with the intermediate deck board is initiated. The end deck board is positioned at an upward inclination from the first side to the second side thereof, while the hook element of the intermediate deck board is partially engaged with the hook element of the end deck board. The end deck board and the last one of the intermediate deck boards thus form an inverted V-shape upon initial engagement with one another. As the second side of the end deck board and the first side of the intermediate deck board at the apex of the inverted V-shape are lowered towards the top side of the base frame upon which they are engaged in the mounted position, the first side of the end deck board slides along the top surface of the joists towards the inner end of the assembled deck structure to a final mounted position as shown in FIG. 8.

Figure 13:
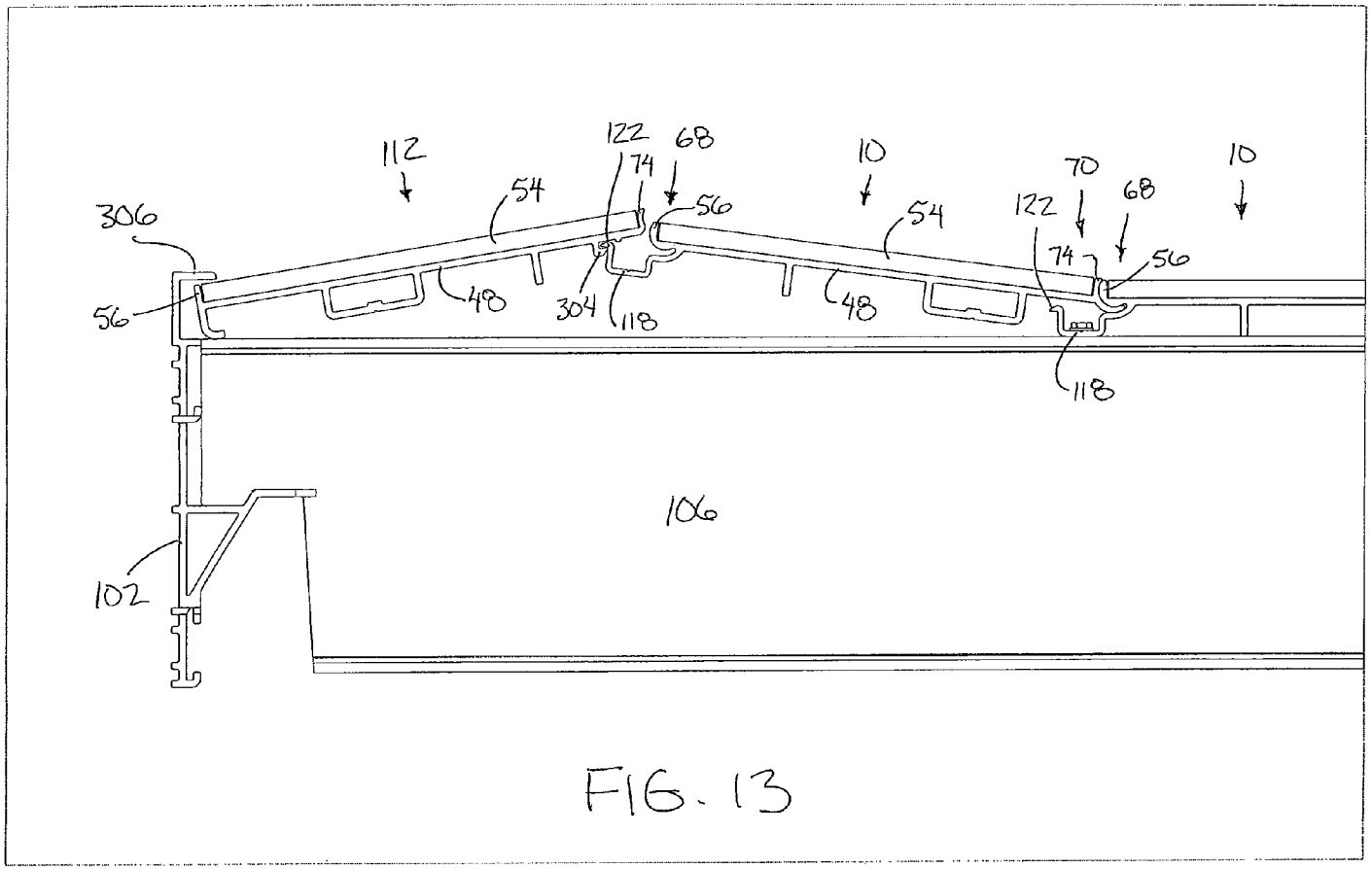
FIG. 13 illustrates the interlocking connection between the final placed intermediate deck board and the end deck board in the decking system according to the second embodiment of FIG. 13.

When using a fully extruded ledger board as shown in FIG. 13 for example, an additional top flange 306 may be provided on the ledger board spaced above the top side of the base frame by the height of the deck boards to receive the first end of the end deck board below the top flange 306 in its final assembled configuration. The final intermediate deck board and the end deck board can then be secured relative to the joists by fasteners inserted from below the base frame. Fastening each of the deck boards prevents relative uplift of the other deck board.

To cap the ends of the deck boards along the laterally opposed sides of the assembled deck structure, a side finishing board 116 is mounted along each of the sides of the deck structure by engagement thereof on the top side of the base frame. Each side finishing board 116 comprises a single extruded main body of aluminum having a continuous cross section or profile along the length thereof between longitudinally opposed ends. The profile includes a main channel defined between a bottom wall 400 which spans substantially the full width of the profile between inner and outer sides thereof and which defines a bottom side of the profile that is engaged upon the top side of the base frame. The top side of the main channel is bound by a top wall 402 which is parallel to the bottom wall and spaced thereabove. Two inner walls 404 span in an upright orientation between the top and bottom walls at laterally spaced positions similarly to the end finishing board such that the top wall 402 is defined between two openings 406 comprising elongate slots which are parallel and laterally spaced apart in the top surface of the overall profile to span the full length thereof.

At both inner and outer sides of the profile, an additional intermediate wall 408 extends upward from the bottom wall 400 spaced laterally from the respective inner wall 404 at the opposing side of a respective one of the openings 406 thereabove. The intermediate walls are spaced from the respective inner walls to define two open cavities, each having a lower portion 410 where the walls are spaced by a first distance to define a mounting fastener channel similar to the lower portion 222 described above. The cavities below each of the openings 406 are also arranged to define an upper portion 412 where the spacing between boundary walls is at a second greater spacing to define a railing fastener channel similar to the upper portion 224 described above. Threaded nuts are longitudinally slidable within the upper portions 412 for receiving threaded fasteners of a railing mounting system also as described above.

Also at the inner side of the side finishing board, there is provided an inner end wall 414 which is vertically oriented and continuous along the length of the side finishing board against which the end of each intermediate deck board is abutted. The end wall 414 extends vertically upward from the innermost end of the bottom wall 400 of the profile. An upper flange 416 is connected between the top end of the end wall 414 and the top end of the intermediate wall 408 such that the upper flange 416 is continuous and flush with the top wall 402 which is in turn continuous and flush with the top side of the intermediate deck boards so as to form respective portions of the upper deck surface of the assembled deck structure. A support flange 418 extends laterally inward from the inner most edge of the bottom wall 400 at a location therebelow such that the top side of the support flange is flush and coplanar with the bottom side of the bottom wall 400. The height between the top side of the support flange and the top side of the top wall corresponds to the height of the deck boards such that the bottom side of the deck boards can be engaged upon the support flange 418 while being flush at the top side thereof with the top side of the side finishing board.

The side finishing board further includes a depending fastener flange 420 extending downwardly from the bottom wall at a location spaced laterally to the interior of the side finishing board relative to the inner end wall 414. The depending fastener flange 420 is arranged to extend downwardly along an inner surface of the outermost joist of the deck structure. A gusset panel 422 extends upwardly and laterally outwardly from a location on the depending fastener flange 420 spaced below the bottom wall 400 to an outer end connected to the bottom end of the inner end wall 414. A remaining portion of the depending fastener flange 420 extending below the gusset panel has an exposed inner side surface which is formed to have a V-shaped profile to assist in centrally locating fasteners penetrated therethrough for fastening to the inner side of the outermost joist along which the depending fastener flange extends in a mounted position.

The outer side portion of the side finishing board includes another intermediate wall 408 spaced outwardly from the corresponding one of the inner walls 404 at the opposing side of the opening 406 thereabove to define the second open cavity having upper and lower portions 410 and 412 as described above. An outer side member 424 is joined to the outermost intermediate wall 408 in which the outer side member 424 has a vertical outer surface forming the outermost edge of the profile.

The outer side member includes a depending flange portion extending vertically downward below the bottom side of the bottom wall 400 engaged upon the top side of the base frame. The depending flange portion of the outer side member 424 is laterally spaced apart from the depending fastener flange 420 towards the inner side by a suitable lateral distance therebetween corresponding to the thickness of the outermost joist. In the illustrated embodiment, the outermost joist comprises two pieces of dimensional lumber which are mounted alongside one another. Similar to the outer depending flange portion of the end finishing board, an undercut area 426 is provided at the bottom of the outer side member 424 to receive the top edge of a flashing member inserted upwardly therein.

The top end of the outer side member extends upwardly to an upper flange 428 which is coplanar with the top wall 422 and spaced apart laterally therefrom by the width of the respective one of the openings 406. The upper flange 428 thus forms a respective portion of the upper deck surface.

The installation of the intermediate deck boards typically involves first mounting the side and end finishing boards about the exterior perimeter boundaries of the base frame as an initial step. Fasteners are penetrated downwardly through the openings in the top sides thereof for securement to respective components of the base frame. Additional fasteners are penetrated laterally through the depending fastener flanges 420 of the side finishing boards. The intermediate deck boards are then installed by interlocking male and female connection to the end finishing board. Each intermediate deck board is fastened with fasteners penetrated through the fastener flange thereof with continued interlocking connection with each subsequently installed intermediate deck board, until installation of the final intermediate deck board together with the end deck board as described above with regard to FIG. 13.

Figure 11:
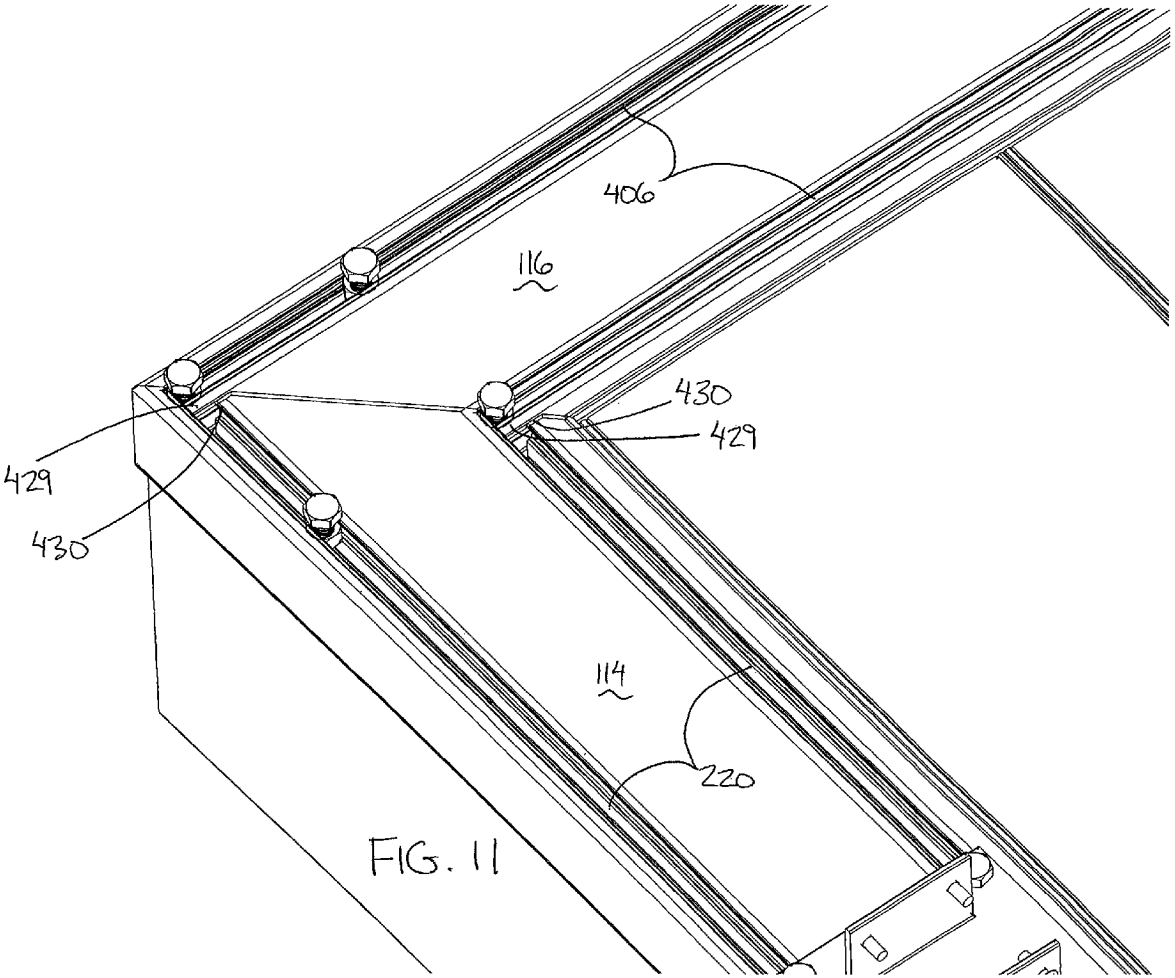
FIG. 11 is a perspective view of a junction between the end finishing board and the side finishing board of the decking system according to FIG. 3.
Figure 12:
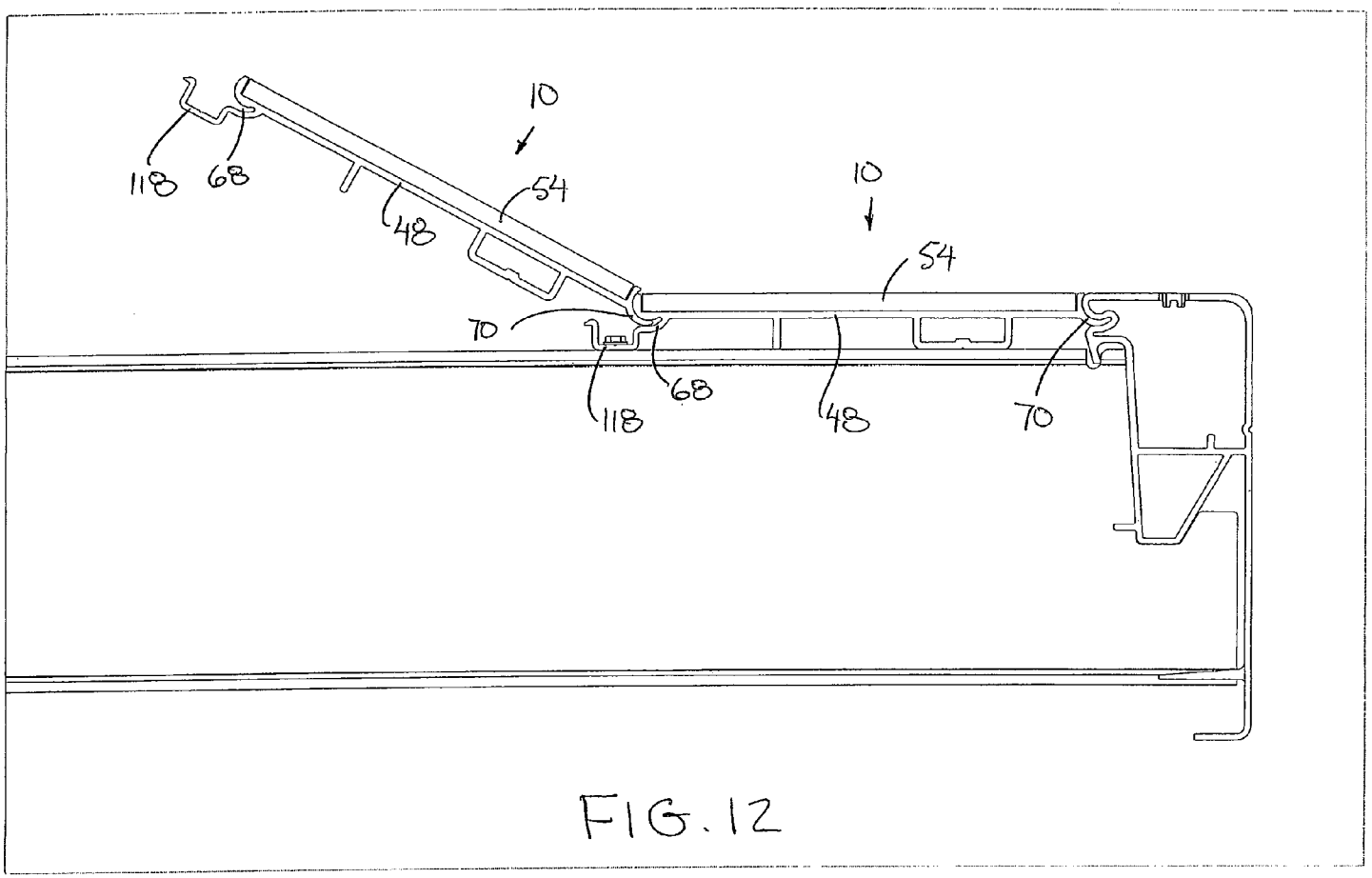
FIG. 12 illustrates the interlocking connection for connecting one of the deck boards according to the second embodiment of FIG. 3 to a previously mounted deck board or the end finishing board.

At the junction of the side finishing boards with the end finishing board, each of the finishing boards is provided with a 45 degree bevel to provide a mitered joint where the central main channels of the boards meet one another. Each side finishing board is further arranged such that the mounting fastener channels and the railing fastener channels thereabove protrude beyond the bevelled edge to terminate at a square edge 429 as best shown in FIG. 11. In this instance, each of the corresponding channels of the end finishing board terminate at a respective recessed portion 430 which is also square and perpendicular to the longitudinal direction of the board for abutment with the protruding square edge of the respective channels of the side finishing boards at either end thereof. Nuts which are slidably displaced along the channels are thus permitted to be placed symmetrically with the mitered seam between the end finishing board and the side finishing boards for fastening corner posts of a railing system thereto.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. In a deck structure comprising:

a base frame comprising a plurality of joists; and a plurality of deck boards spanning in respective longitudinal directions across the plurality of joists and defining an upper deck surface, each deck board including a top surface forming a respective portion of the upper deck surface, a bottom side below the top surface and engaged upon the joists, a female interlocking element spanning in a longitudinal direction of the intermediate deck board along a first side of the deck board and a male interlocking element spanning in the longitudinal direction along a second side of the deck board opposite the first side;

whereby the female interlocking element is arranged to receive the male interlocking element of a first adjacent one of the deck boards that is adjacent the first side of the deck board and the male interlocking element is arranged to be received into the female interlocking element of a second adjacent one of the deck boards that is adjacent the second side of the deck board;

the improvement comprising each deck board comprising:

a main body forming a U-shaped, recessed channel spanning in the longitudinal direction along a top of the main body; and an insert body received within the recessed channel in the top of the main body and formed of a different material than the extruded body which defines the top surface of the deck board;

wherein the main body comprises:

a panel including a top side and a bottom side spanning laterally between the first and second sides of the deck board along a length of the deck board;

a first upright flange and a second upright flange extending upwardly from the top side of the panel along the first and second sides of the deck board so as to define the U-shaped, recessed channel together with the top side of the panel;

the female interlocking element being defined below the bottom side of the panel at the first side of the deck board;

the male interlocking element protruding laterally outwardly beyond the second upright flange at the second side of the deck board so as to be arranged to be engaged with the bottom side of the panel of said second adjacent one of the deck boards; and a fastener flange at the bottom side of the first side of the deck board which extends laterally outward relative to the panel beyond the first upright flange.

2. The improvement according to claim 1 further comprising an upstanding flange extending upwardly from the fastener flange at a location which is spaced laterally outwardly from the first upright flange and which is engaged with the bottom side of the panel of said first adjacent one of the deck boards.

3. The improvement according to claim 1 further comprising at least two deck boards mounted longitudinally in series with one another such that the main bodies of said two deck boards are abutted with one another and the insert bodies are spaced from one another by a spacer element which is formed of a material which is more resilient than a material of the insert bodies.

4. The improvement according to claim 1 wherein each deck board comprises a single main body spanning a full length of the deck board and a plurality of separate bodies received within the recessed channel so as to be longitudinally in series with one another.

5. The improvement according to claim 4 wherein each deck board further comprises a spacer element supported between each adjacent pair of separate bodies are spaced apart by a spacer element received therebetween, the spacer element being formed of a material which is more resilient than a material of the separate bodies.

6. The improvement according to claim 1 further comprising a plurality of fasteners penetrated through the fastener flange of each deck board and into respective ones of the joists.

7. The improvement according to claim 1 wherein the main body comprises extruded metal.

8. The improvement according to claim 1 wherein the insert body is a rigid unitary material.

9. The improvement according to claim 1 wherein the insert body comprises a single, unitary panel spanning in the longitudinal direction between opposing ends of the main body.

10. The improvement according to claim 1 further comprising a bonding material securing the insert body to the main body.

11. The improvement according to claim 1 wherein an upper surface of the insert body is substantially flush with the the first and second upright flanges at the top of the main body.

12. The improvement according to claim 1 wherein the main body further comprises a plurality of ribs depending downwardly from the bottom side of the panel at laterally spaced apart positions between the first and second sides of the deck board.

13. The improvement according to claim 1 wherein the deck structure further comprises an end finishing board arranged to span across the plurality of joists at one end of the deck structure alongside a corresponding one of the deck boards, the end finishing board including:

an interlocking element formed longitudinally along one side thereof which is arranged to mate in interlocking connection with one of the interlocking elements on the corresponding deck board so as to prevent relative uplift of the boards from the base frame;

a bottom side arranged to be abutted against a top side of the base frame; and a depending flange extending downwardly from the bottom side along a length of the end finishing board so as to be arranged for abutment against an upright surface at a perimeter of the base frame.

14. The improvement according to claim 1 wherein the deck structure further comprises a side finishing board arranged to span along one side of the deck structure against which ends of a plurality of the deck boards are abutted, the side finishing board including:

a top surface forming a respective portion of the upper deck surface;

a bottom side below the top surface and engaged upon the base frame;

an inner side wall against which the ends of the deck boards are arranged to be abutted; and a support flange protruding laterally from the inner side wall beyond an inner edge of the top surface at a location spaced below the top edge so as to be arranged to support the bottom side of the deck boards thereon.

15. In a deck structure comprising:

a base frame comprising a plurality of joists; and a plurality of intermediate deck boards spanning longitudinally across the plurality of joists and defining an upper deck surface, each intermediate deck board including a top surface forming a respective portion of the upper deck surface, a bottom side below the top surface and engaged upon the joists, a first side portion spanning in a longitudinal direction of the intermediate deck board along a first side of the intermediate deck board and defining a female interlocking element formed thereon, a second side portion spanning in the longitudinal direction along a second side of the intermediate deck board opposite the first side and defining a male interlocking element arranged for interlocking connection with the female interlocking element of an adjacent one of the intermediate deck boards;

the improvement comprising an end finishing board arranged to span across the plurality of joists at one end of the deck structure alongside a corresponding one of the intermediate deck boards, the end finishing board including:

an interlocking element formed longitudinally along one side thereof which is arranged to mate in interlocking connection with one of the interlocking elements on the corresponding intermediate deck board so as to prevent relative uplift of the boards from the base frame;

a bottom side arranged to be abutted against a top side of the base frame; and a depending flange extending downwardly from the bottom side along a length of the end finishing board so as to be arranged for abutment against an upright surface at a perimeter of the base frame.

16. The improvement according to claim 15 wherein the depending flange is substantially flush with an outermost upright side edge of the end finishing board.

17. The improvement according to claim 15 wherein the depending flange includes an undercut recess at an inner side adjacent a bottom thereof so as to be arranged to receive a top edge of an upright finishing panel therein.

18. In a deck structure comprising:

a base frame comprising a plurality of joists; and a plurality of intermediate deck boards spanning longitudinally across the plurality of joists and defining an upper deck surface, each intermediate deck board including a top surface forming a respective portion of the upper deck surface and a bottom side below the top surface and engaged upon the joists;

the improvement comprising a side finishing board arranged to span along one side of the deck structure against which ends of a plurality of the intermediate deck boards are abutted, the side finishing board including:

a top surface forming a respective portion of the upper deck surface;

a bottom side below the top surface and engaged upon the base frame;

an inner side wall against which the ends of the intermediate deck boards are arranged to be abutted; and a support flange protruding laterally from the inner side wall beyond an inner edge of the top surface at a location spaced below the top edge so as to be arranged to support the bottom side of the intermediate deck boards thereon.

19. The improvement according to claim 18 wherein the support flange of the side finishing board is spaced below the top surface of the side finishing board by a height of the intermediate deck boards such that the top surface of the side finishing board is arranged to be flush with the top surfaces of the intermediate deck boards.

20. The improvement according claim 18 wherein the support flange of the side finishing board is offset below the bottom side of the side finishing board which is engaged upon the base frame such that a top side of the support flange is substantially coplanar a top side of the base frame supporting the intermediate deck boards thereon.

21. The improvement according to claim 18 wherein the side finishing board further comprises an inner depending flange depending downwardly from the bottom side of the side finishing board which is engaged upon the base frame so as to be arranged for fastening to an inner surface of an outermost one of the joists of base frame.

* * * * *